United States Patent [19]

Sato et al.

[11] Patent Number: 5,009,177

[45] Date of Patent: Apr. 23, 1991

[54] THREAD CUTTING UNIT HAVING A ROTATABLY DRIVEABLE CUTTING KNIFE AND LOOP SPREADING PLATE FOR A SEWING MACHINE

[75] Inventors: Shuichi Sato; Yoshimi Koguchi; Yoshiharu Kobayashi, all of Tochigi, Japan

[73] Assignee: SSMC Inc., Edison, N.J.

[21] Appl. No.: 410,789

[22] Filed: Sep. 22, 1989

[30] Foreign Application Priority Data

Oct. 21, 1988 [JP] Japan ..... 63-137558[U]

[51] Int. Cl.[5] ..... D05B 65/02; D05B 69/00; D05B 65/00

[52] U.S. Cl. ..... 112/292; 112/285; 112/294; 112/295; 112/291; 112/293; 112/296; 112/297; 112/298; 112/300

[58] Field of Search ..... 112/181, 189, 228, 286, 112/288, 291, 292, 293, 294, 295, 296, 297, 298, 300

[56] References Cited

U.S. PATENT DOCUMENTS

| | | | |
|---|---|---|---|
| 3,605,664 | 9/1971 | Hedegaard | 112/292 |
| 3,728,978 | 4/1973 | Honda | 112/292 |
| 3,776,161 | 12/1973 | Papajewski | 112/292 |
| 3,921,554 | 11/1975 | Uozaki | 112/292 |
| 4,077,342 | 3/1978 | Steckenrider | 112/292 |
| 4,098,208 | 7/1978 | Hedegaard | 112/291 |
| 4,141,307 | 2/1979 | Okada | 112/292 |
| 4,256,048 | 3/1981 | Jung | 112/292 |
| 4,395,961 | 8/1983 | Papajewski | 112/291 X |
| 4,437,423 | 3/1984 | Yamazawa | 112/292 |
| 4,589,362 | 5/1986 | Düsch | 112/300 X |

*Primary Examiner*—Werner H. Schroeder
*Assistant Examiner*—Ismael Izaguirre
*Attorney, Agent, or Firm*—Theodore Jay

[57] ABSTRACT

A thread cutting unit cooperating with the bed of a sewing machine includes a lower shaft, a cutting knife and a loop spreading plate respectively fixed to the lower shaft and positioned adjacent to the hook. The thread cutting knife and the loop spreading plate cross each other in a space between the hook and the throat plate. The thread cutting unit is provided with a thread cutting driving unit which comprises a thread cutting knife driving shaft, a loop spreading plate driving shaft, a rotational motion transmission device, a thread cutting supporting member carrying thread cutting knife, a first turnable interlocking mechanism and a second turnable interlocking mechanism. The thread cutting supporting member is rotatably supported on the bed.

4 Claims, 8 Drawing Sheets

THREAD CUTTING UNIT HAVING A ROTATABLY DRIVEABLE CUTTING KNIFE AND LOOP SPREADING PLATE FOR A SEWING MACHINE

BACKGROUND OF THE INVENTION

1. Field of the Invention

The present invention relates to a thread cutting unit associated with a bed of the sewing machine.

2. Description of the Prior Art

A thread cutting unit of this type is conventionally a knife for cuttting off the stitching thread composed of a needle thread and a bobbin thread at a selected position of the sewn cloth, namely at a position between the throat plate on which the sewn cloth is placed and a hook during which a needle moves to an upper stop position raised from the surface of the sewn cloth after completion of the stitching operation. The sewing machine having such an arrangement is called a thread cutting sewing machine.

In such a conventional thread cutting unit, it is desirable to cut off the needle thread and the bobbin thread by the knife at the position under the throat plate which is as close as possible to the under surface of the sewn cloth after completion of the stitching operation in order to permit the cut end of both threads to remain as long as possible at the side of the sewing machine.

Furthermore, when the needle thread and the bobbin thread are cut off at the portion which is as close as possible to the throat plate, the thread ends of both the needle thread and the bobbin thread remaining on the sewn cloth are so shortened and a later process for removing the thread ends from the sewn cloth is not needed.

However, in a sewing machine a gap between the throat plate and the hook is in general very narrow whereas the known thread cutting units are complex and large. Hence it was difficult to cut off both the needle thread and the bobbin thread at the ideal position close to the sewn cloth.

For example, the thread cutting unit disclosed in the Japanese Patent Laid-Open Publication No. 58-41597 has been designed to solve the problems set forth above by increasing the gap between the hook and the throat plate at the time of thread cutting operation and the thread cutting knife and the like are driven via a link mechanism for converting the linear motion generated by a solenoid to rotational motion. However, since the operation of the thread cutting knife is carried out only by the solenoid independently of the sewing operation, the operating timing thereof is not precise and the lengths of the thread ends of the cut needle thread and the bobbin thread are not uniform but variable.

SUMMARY OF THE INVENTION

It is an object of the present invention to provide a thread cutting unit capable of shortening precisely the threads ends remaining on the sewn cloth whereby non-uniformity of the lengths of the thread ends is eliminated.

Another object is to provide a thread cutting unit having a significantly simplified structure.

Still another object is to provide a thread cutting unit having a simplified structure wherein the rotational motion of a lower shaft is transmitted to a thread cutting knife driving shaft or a loop spreading plate driving shaft with simple structure.

To achieve the above objects, the present invention utilizes a bed of a sewing machine. A lower shaft is rotatably supported in a bearing secured to the bed. A needle movable vertically is held at the side of the bed. A throat plate is mounted on the bed. A hook is secured to the lower shaft and rotates therewith. The hook cooperates with the needle which extends beyond a throat of the machine during the stitching operation. A thread cutting knife and a loop spreading plate are respectively secured to the lower shaft and are positioned adjacent to the hook. The thread cutting knife and the loop spreading plate cross each other in the space between the hook and the throat plate in order to cut a sewing thread after completion of a series of stitching operations. A thread cutting driving unit drives the thread cutting knife and the loop spreading plate. The thread cutting driving unit includes a thread cutting knife driving shaft and a loop spreading plate driving shaft which are respectively rotatably supported in bearings secured to the bed of the sewing machine. A rotational motion transmission unit transfers rotational motion of the lower shaft to the thread cutting knife driving shaft and the loop spreading plate driving shaft. A thread cutting supporting member has the thread cutting knife secured thereto and rotatably supported by the bed a first turnable interlocking mechanism capable of turning at four points thereon has a driving body fixed to the thread cutting knife driving shaft and a driven body integrated with the thread cutting supporting member. A loop spreading plate fixing member is rotatably supported by the bed of the sewing machine, has the loop spreading plate, and a second turnable interlocking mechanism capable of turning at four points thereon. The second machanism has a driving body secured to the loop spreading plate driving shaft and a driven body integrated with the spreading plate fixing member.

The above and other objects, features and advantages of the present invention will become more apparent from the following description taken in conjunction with the accompanying drawings.

PREFERRED EMBODIMENT OF THE INVENTION

Figure 1:
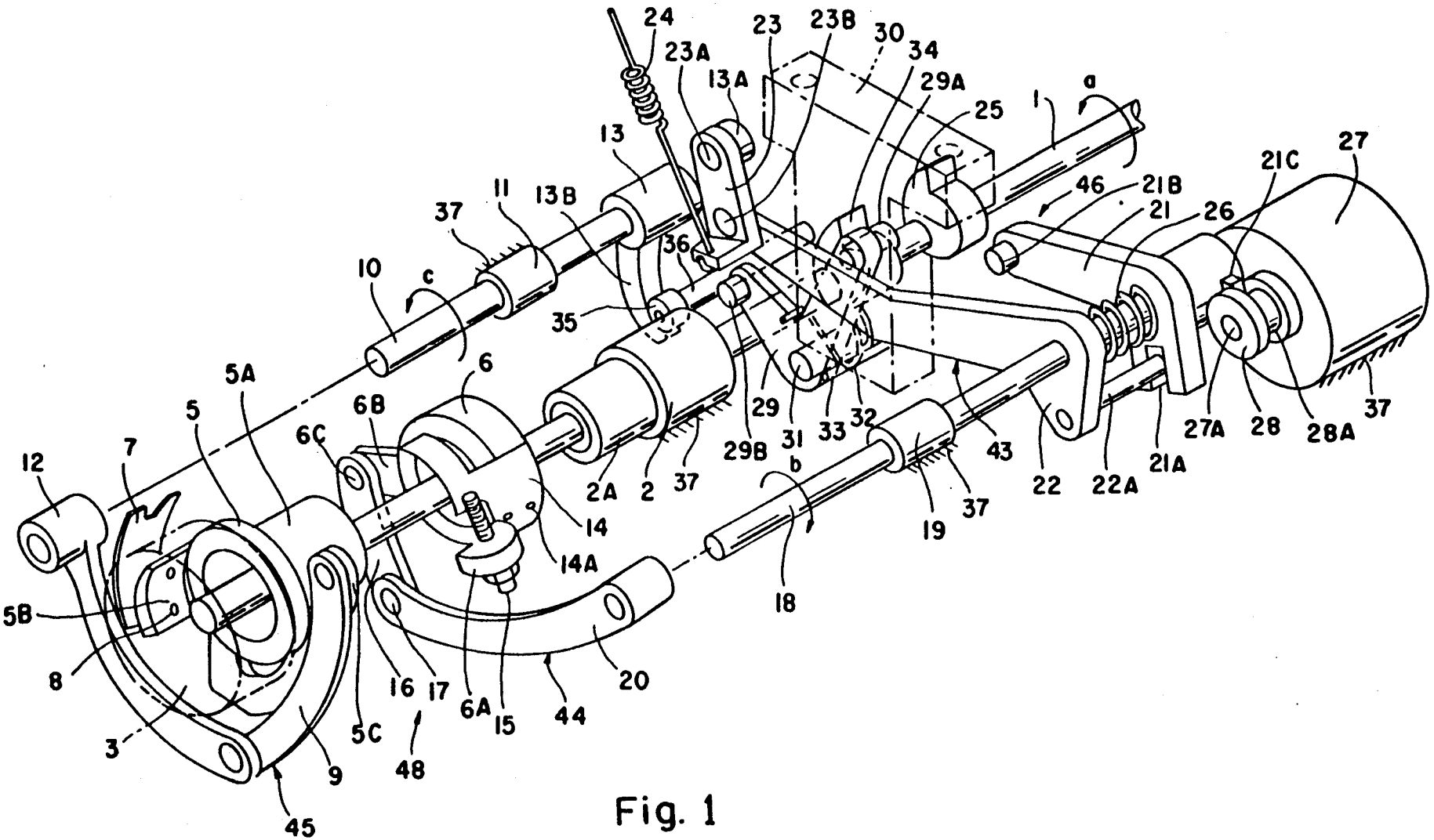
FIG. 1 is a perspective exploded view of a thread cutting unit in a sewing machine in accordance with a preferred embodiment of the present invention.
Figure 2:
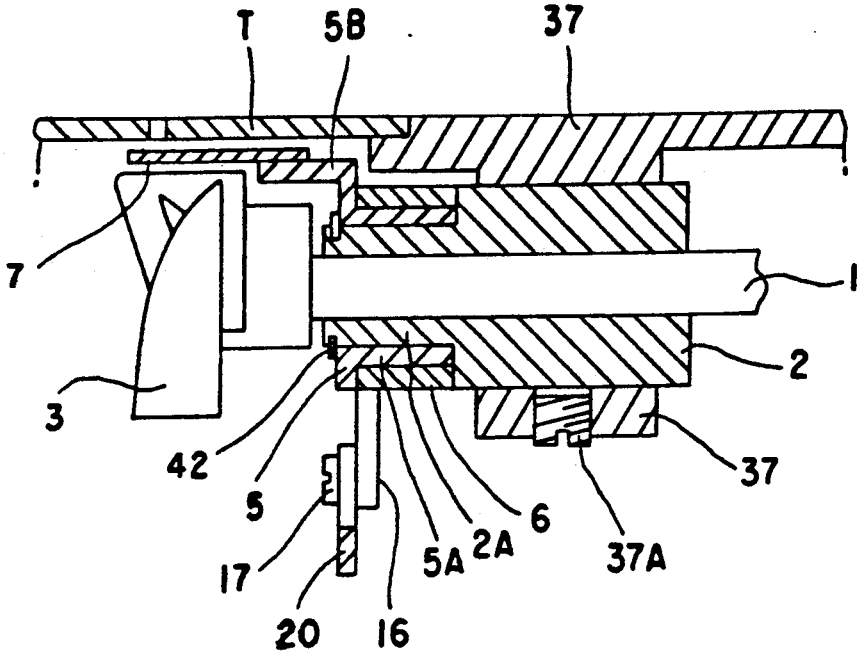
FIG. 2 is a cross sectional view of a main portion of the thread cutting unit of FIG. 1.

A perferred embodiment of the present invention is described below with reference to FIGS. 1-14.

A sewing machine has a bed 37. A lower shaft 1 is rotatably supported in the bed 37. A needle 39 is movable vertically and is supported at the side of the bed 37 of the sewing machine. A throat plate T is mounted on the bed 37 of the sewing machine. A hook 3 is secured to the lower shaft 1 for cooperation with the needle 39. Needle 39 extends through the throat plate T during a stitching operation. A thread cutting knife 14 and a loop spreading plate 7 are respectively secured to the lower shaft 1 and are positioned adjacent to the hook. The thread cutting knife 14 and the loop spreading plate 7 cross each other in the space between the hook 3 and the throat plate T for cutting a sewing thread after completion of a series of stitching operations. A thread cutting driving unit 48 drives the thread cutting knife 14 and the loop spreading plate. The thread cutting driving unit 48 includes a thread cutting knife driving shaft 18 and a loop spreading plate driving shaft 10 both of which are respectively rotatably supported in members 11 and 19 which are secured to the bed 37 of the sewing machine. A rotational motion transmission device 46 transmits a rotational motion of the lower shaft 1 to both the thread cutting knife driving shaft 18 and the loop spreading plate driving shaft 10. A thread cutting supporting member 6 has the thread cutting knife 14 secured thereto and is rotatably supported in member 2 which is secured to the bed. A first turnable interlocking mechanism 44 capable of turning at four points thereon has a driving body fixed to the thread cutting knife driving shaft 18 and a driven body integrated with the thread cutting supporting member. A loop spreading plate securing member 5 is rotatably supported in a support secured to the bed 37. A second turnable interlocking mechanism 45 capable of turning at four positions thereon has a driving body fixed to the loop spreading plate driving shaft 10 and a driven body integrated with the loop spreading plate securing member.

The lower shaft 1, the loop spreading plate driving shaft 10 and the thread cutting knife driving shaft 18 are rotatably supported by the bed 37. The lower shaft 1 is rotatably supported by a bearing 2 which is fixed to the bed 37 by a set 37A. The loop spreading plate driving shaft 10 has its axial line extending in parallel with the lower shaft 1 and is positioned within the same horizontal surface as that of the lower shaft 1 so that the loop spreading plate driving shaft 10 is rotatably supported by a bearing 11 on the bed 37 but is not movable in the axial direction. The thread cutting knife driving shaft 18 is positioned in symmetry with the loop spreading plate driving shaft 10 about the lower supporter 1 and is rotatably supported by bearing 19 on the bed 37 but is not movable in the axial direction.

The lower shaft 1 is interlocked with an upper shaft (not shown) of the frame of the sewing machine by a known structure and is rotatable for two turns in the direction of the arrow a as shown in FIG. 1 when the upper shaft makes one turn. The lower shaft 1 has the hook 3 turnable at complete rotation at one end thereof. The lower shaft is also interlocked with the known stitch forming mechanism 40 comprising a needle 39 (shown in FIG. 12) held by an arm on the bed 37 and the like so that a lock stitch is formed on a sewn cloth 41 on the throat plate T mounted on the bed 37.

The bearing 2 has a tip end small diameter portion 2A protruding in the axial direction of the bearing 2. The small diameter portion 2A has at the outer periphery thereof a boss 5A of the loop spreading plate securing member 5. The boss 5A is rotatably supported by the small diameter portion 2A and restricted in its axial movement. The loop spreading plate securing member 5 has a securing edge 5B protruded from one end thereof. The securing edge 5B has the loop spreading plate 7 of arc shape secured thereto by a securing screw 8 and extends adjacent to an outer periphery of the hook 3 rotatable in complete direction. The boss 5A of the loop spreading plate securing member 5 has an outer peripheral surface on which the thread cutting knife supporting member 6 is rotatably supported with restriction of its axial movement. The thread cutting knife supporting member 6 has an outer periphery to which the thread cutting knife 14 the arc shape is secured thereto by a small screw 14A, knife 14 cooperates with the loop spreading plate 7 for cutting the needle thread between the hook 3 and throat plate T. A thread cutting knife adjusting screw 15 is screwed into the boss 6A of the thread cutting knife supporting member 6 so that the depth of the thread cutting knife adjusting screw 15 in boss 6A and the amount of contact between a tip end of the thread cutting knife adjusting screw 15 and an outer surface of the thread cutting knife 14 are respectively adjusted increasingly or decreasingly whereby the desired positional relationship betweeen the thread cutting knife 14 and the loop spreading plate 7 can be established.

Figure 5:
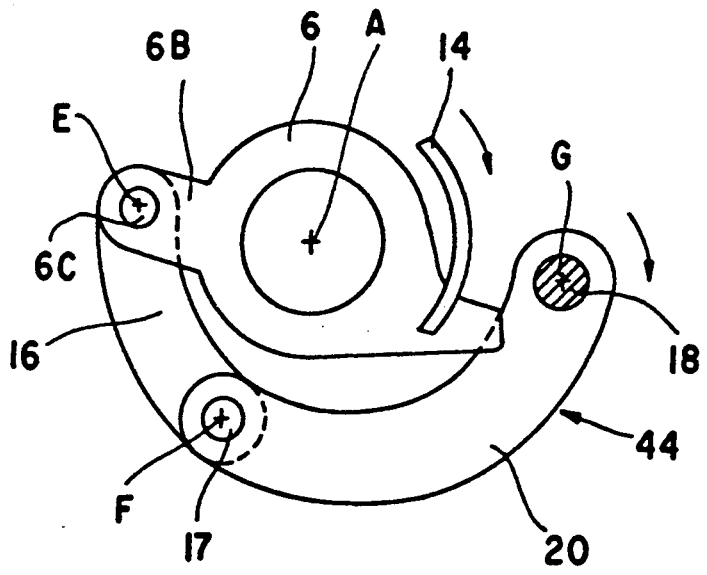
FIG. 5 illustrates a first turnable interlocking mechanism of FIG. 1 in a return state.
Figure 6:
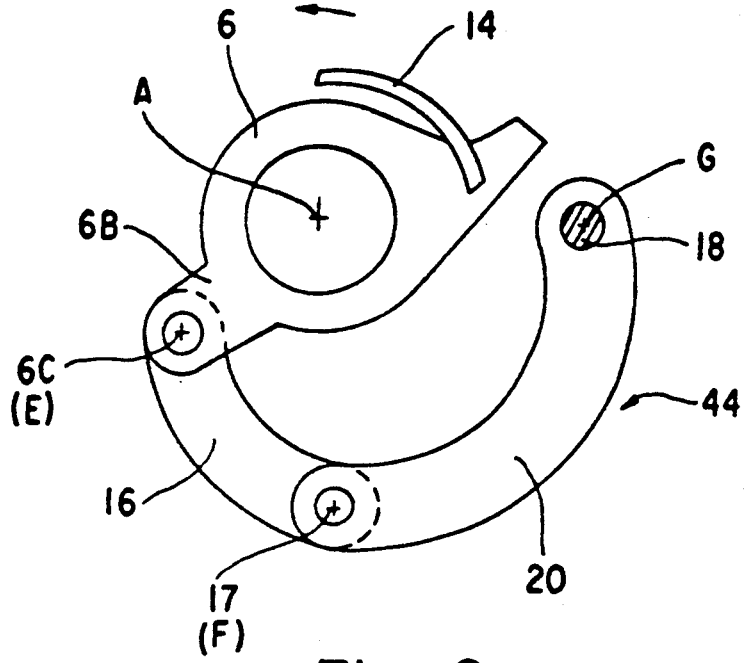
FIG. 6 illustrates a thread cutting operation state of the first turnable interlocking mechanism of FIG. 1.

As shown in FIGS. 5 and 6, the arm 6B extending to the loop spreading plate driving shaft 10 has a tip portion rotatably connected to one end of a thread cutting knife operation link 16 by a pin 6C. The other end of the thread cutting knife operation link 16 is rotatably connected to one end of a thread cutting knife operation arm 20 by a pin 17. The other end of the thread cutting knife operation 20 is secured to the tip end of the thread cutting knife driving shaft 18. The first turnable interlocking mechanism 44 uses the thread cutting knife driving shaft 18 as driving body composed of a center A of the thread cutting knife supporting member 6, a fulcrum E of the thread cutting knife operation link 16, a fulcrum F of the thread cutting knife operation arm 20 and a center G of the thread cutting knife driving shaft 18. A driven body consists of the thread cutting knife supporting member 6. The loop spreading plate fixing member 5 has an arm 5C at the outer periphery thereof. The arm 5C has an L-shape configuration, a base extending downward and a tip portion extending upward in the thread cutting inoperative state. One end of a loop spreading plate operation link 9 for rotatably driving the loop spreading plate fixing member 5 is connected to the tip portion of the arm 5C by a pin B and the other portion of the loop spreading plate operation link 9 is connected to one end of a loop spreading plate operation arm 12. The other end of the loop spreading plate operation arm 12 is fixed to the tip portion of the loop spreading plate driving shaft 10. The second turnable interlocking mechanism 45 uses a driving body composed of the center A of the loop spreading plate fixing member 5, a fulcrum B of the loop spreading plate operating link 9, a fulcrum C of the loop spreading plate operation arm 12 and a center D of the loop spreading plate driving shaft 10. A driven body consists of the loop spreading plate securing member 5. The first and second turnable interlocking mechanisms 44 and 45 are precisely synchronized with each other so that a stitching thread composed of a bobbin thread BT and a needle thread NT is cut off by an appropriate crossing of the thread cutting knife and the loop spreading plate 7 after completion of series of stitches on the sewn cloth 41.

A rotational motion transmission mechanism 43 is disposed between the loop spreading plate driving shaft 10 and the thread cutting knife driving shaft 18 for transmitting the rotational motion to the loop spreading plate driving shaft 10 and the thread cutting knife driving shaft 18. The rotational motion transmission mechanism 43 comprises a thread cutting bell crank 22 having a middle portion fixed to the thread cutting knife driving shaft 18, a loop spreading plate driving link 23 having one end rotatably connected to the other end of the thread cutting bell crank 22 by a stepped pin 23B, and a loop spreading plate driving arm 13 having one end rotatably connected to the other end of the loop spreading plate driving link 23 by a pin 23A. A cylindrical middle portion of the loop spreading plate driving arm 13 is secured to the loop spreading plate driving shaft 10.

Figure 7:
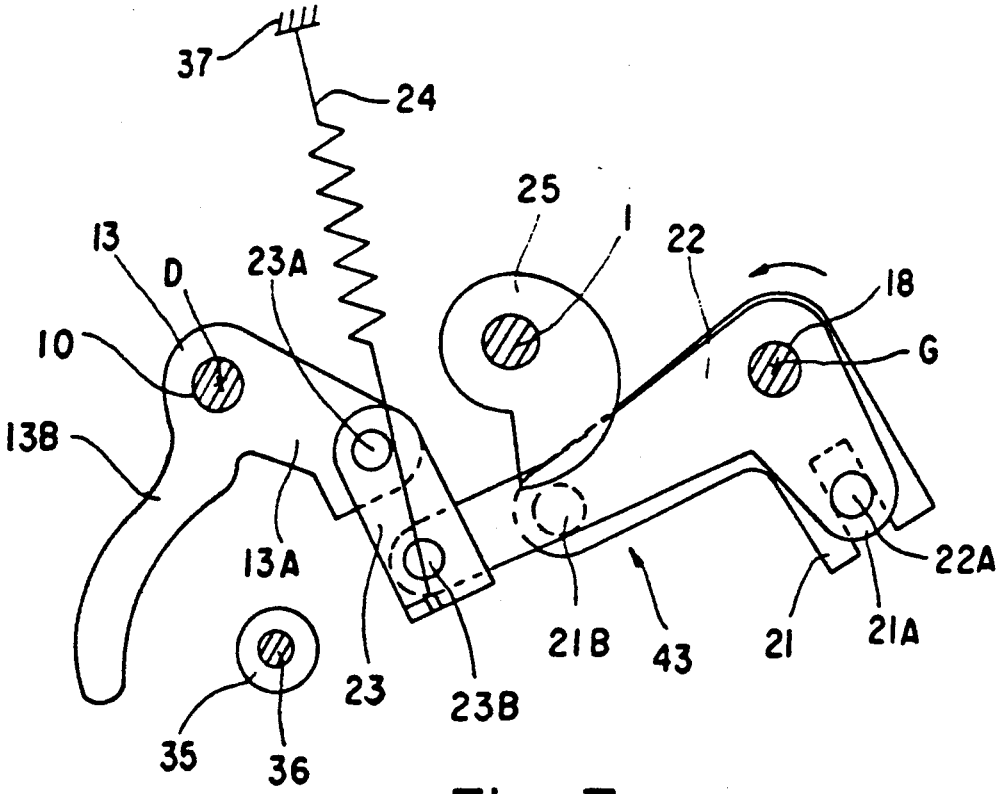
FIG. 7 illustrates a thread cutting operation state of a rotational motion transmission of FIG. 1.
Figure 8:
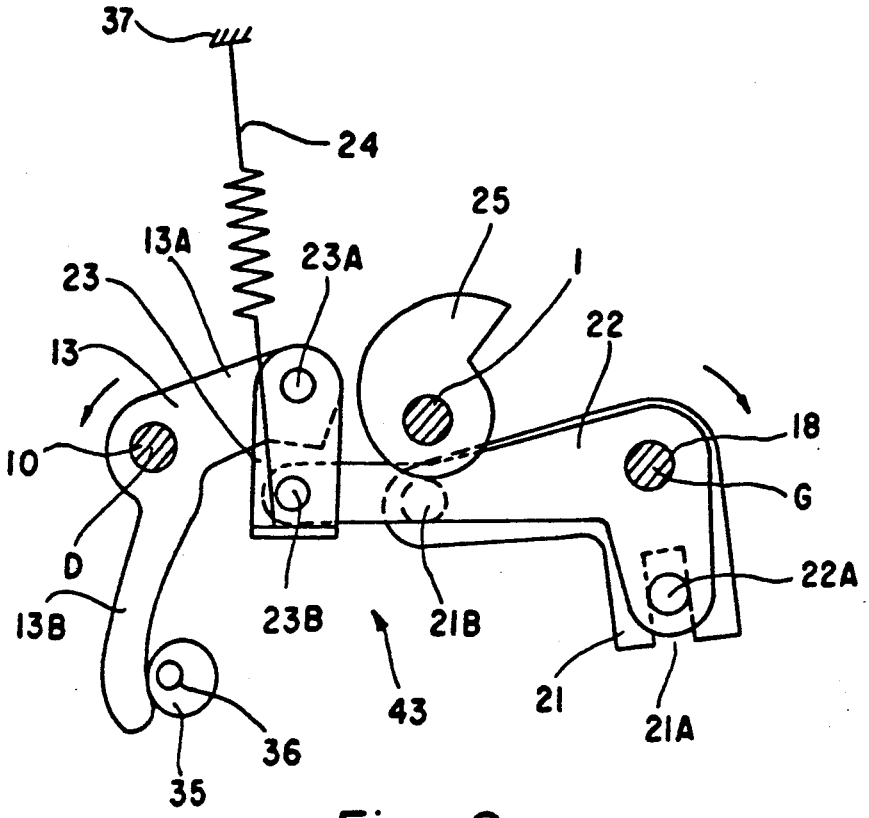
FIG. 8 illustrates a return state of the rotational motion transmission mechanism of FIG. 1.

As explained in detail in FIGS. 7 and 8, the center G of the thread cutting knife driving shaft 18, both fulcrums 23*a*, 23*b* of the loop spreading plate driving link 23, and the center D of the loop spreading plate driving shaft 10 utilize the thread cutting knife driving shaft 18 as the driving body and the loop spreading plate driving shaft 10 as the driven body thereby forming the rotational motion transmission machanism 43 having four parts driving rotation link mechanism. In the rotational motion transmission mechanism 43, the loop spreading plate driving link 23 is urged in return position by a return spring 24 extended between one end of the loop spreading plate driving link 23 and the bed 37. The loop spreading plate driving shaft 10 rotates in the direction of the arrow c shown in FIG. 1 and the thread cutting knife driving shaft 18 rotates in the direction of the arrow b to return respectively to their original positions. The original position of the rotational motion transmission mechanism 43 is restricted in the manner that an outer peripheral surface of a restriction ring 35 is brought into contact with the other end 13*b* of the loop spreading plate driving arm 13. The restriction ring 35 is engaged with a support shaft 36 protruded from the bracket 30 secured to the bed 37 in the manner that the restriction ring 35 is rotatable in eccentric relation with the support shaft 36 with a predetermined friction force. Consequently, a movable diameter of the restriction ring 35 is varied to thereby increase or decrease the rate of rotational motion of the loop spreading plate driving arm 13. The rotational motion transmission mechanism 43 can be operated by a gear mechanism.

The thread cutting knife 14 for cutting the stitching thread and the thread cutting driving unit 48 for driving the loop spreading plate 7 are composed of the loop spreading plate driving shaft 10, the thread cutting knife driving shaft 18, the first turnable interlocking mechanism 44, the second turnable interlocking mechanism 45, and the rotational motion transmission mechanism 43.

A pin 22A protruded from one end of the thread cutting bell crank 22 has a tip portion engaged in a fork portion 21A while a thread cutting lever 21 is slidable axially engaged with the thread cutting knife driving shaft 18 at the middle portion thereof. The thread cutting lever 21 has at the other end thereof a rotatable thread cutting lever roller 21B. The thread cutting lever 21 is mounted around the outer periphery of the thread cutting knife driving shaft 18 and is urged at all times in one direction to be returned to the original position by a compression spring 26 interposed between the thread cutting bell crank 22 and the thread cutting lever 21, consequently a thread cutting lever roller 21B is disengaged in the normal state from a thread cutting cam 25 fixed to the lower shaft 1.

The thread cutting cam 25 is secured to the lower shaft 1 and has a cam surface having a radius vector varible from a small diameter portion a, a middle diameter portion b, a larger diameter portion c, and a largest diameter portion d. The thread cutting cam 25, the thread cutting lever 21 engaged with the pin 22A, form a rotational motion transmission unit 46 by which the rotational motion of the lower shaft 1 is transmitted to the thread cutting knife driving shaft 18.

Figure 9:
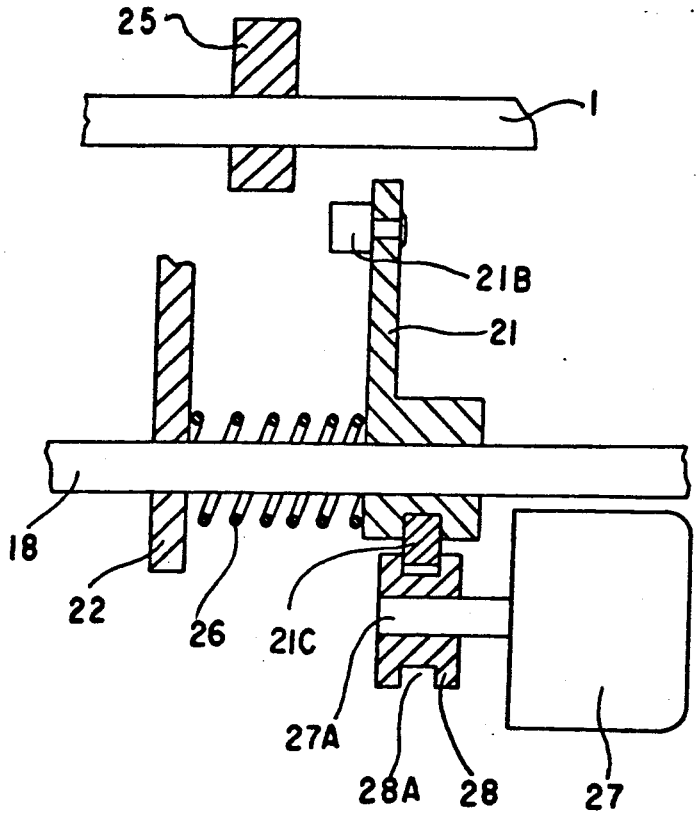
FIG. 9 is a cross sectional view showing a solenoid of FIG. 1 in an operative state.
Figure 10:
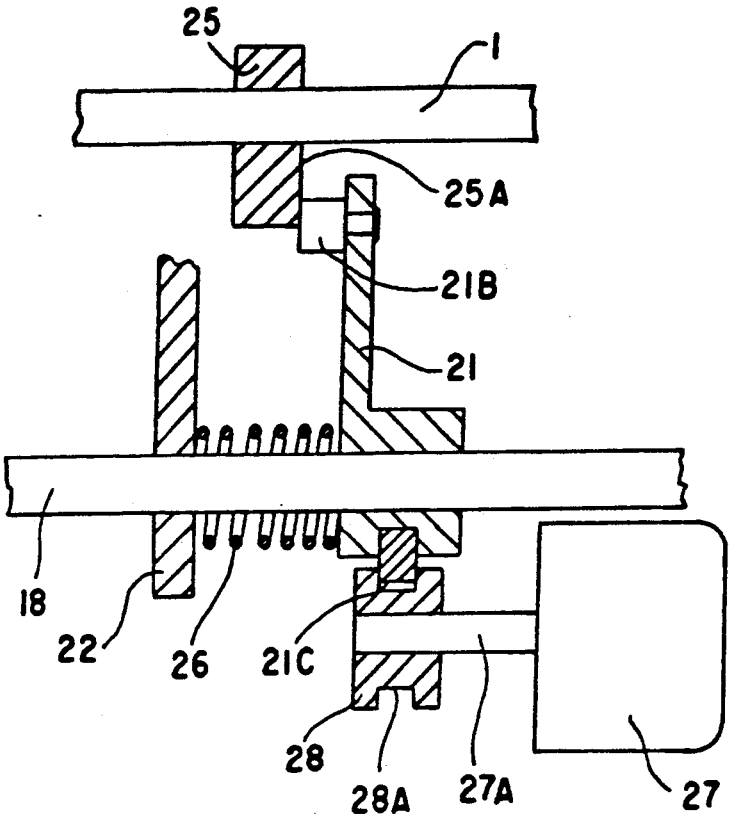
FIG. 10 is a cross sectional view showing in an operative state the solenoid of FIG. 1.

A solenoid 27 attached to a bracket fixed to the bed 37 has a piston rod (core) 27A which is movable forward from an inoperative state as shown in FIG. 9 to an operative state as shown in FIG. 10 upon receipt of a thread cutting signal issued from an external control unit (not shown). As shown in FIG. 9, a projection 21C having an irregular annular shape and secured to the thread cutting lever 21 is engaged in an annular groove 28A of the thread cutting operation ring 28 secured to the tip portion of the piston rod 27A. With such an arrangement, when the piston rod 27A is moved forward, as shown in FIG. 10, the thread cutting lever 21 forces the compression spring 26 to compress and slides on the threading cutting knife driving shaft 18 so that the thread cutting lever roller 21B engages the thread cutting cam 25. The thread cutting lever 21 is capable of rotating about the thread cutting knife driving shaft 18 without hindrance of the projection 21C when the thread cutting lever roller 21B engages with the thread cutting cam 25.

Figure 13:
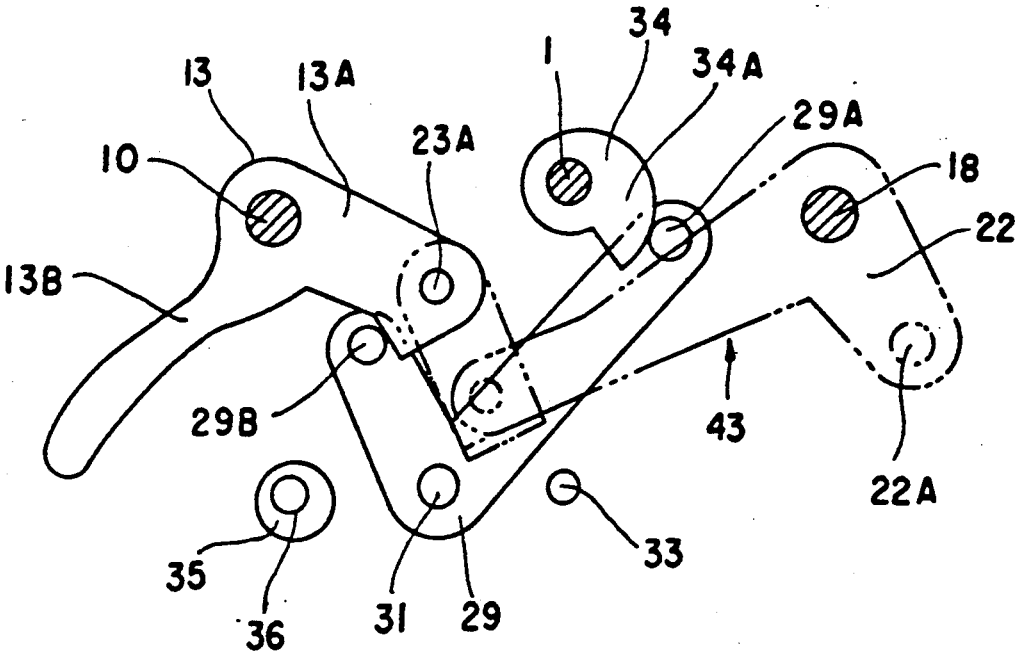
FIG. 13 is a view of a bell crank used in the invention.

A return bell crank 29 as shown in FIGS. 1 and 13 has a central portion rotatably supported by a support shaft 31 projecting from the bracket 30 fixed to the bed 37 and is immovable in the axial direction. One end of crank has a roller 29A rotatably mounted thereon, and the other end has a pin 29B fixed thereto. The return bell crank 29 is rotatably urged, in the clockwise direction in FIG. 1, by the return spring 32 having one end fixed to the bracket 30 and the other end elastically engaged with the one end of the return bell crank 29. In the normal state, the return bell crank 29 is positioned in the return position where the return bell crank 29 is brought into contact with a restriction pin 33, and at the time of return to the original position after completion of the cutting operation the roller 29A engages with the return cam 34 fixed to the lower shaft 1 while the pin 29B engages with the one end 13A of the loop spreading plate driving arm 13 so as to push the one end 13A.

An operation of the thread cutting unit in a sewing machine will be described hereinafter.

After completion of sewing operation, the needle 29 is temporarily stopped, upon reception of the signal issued from a control unit by operating the pedal. The needle 39 is moved to the upper stop position by the operation of the control unit; a signal is received from the control unit. Upon reception of the signal the loop spreading plate 7 and the thread cutting knife 14 automatically cut the needle thread NT and the bobbin thread BT at the position under the sewn cloth 41 and the needle plate T.

FIGS. 1, 3, 5, 8 and 9 respectively show the state where the thread cutting operation is not carried out.

As shown in FIG. 9, since the cylinder rod 27A of the solenoid 27 is in a return original position, namely not moved forward from the solenoid 27, the thread cutting lever 21 is returned to its original position together with the thread cutting operation ring 28 secured to the cylinder rod 27A by the resilient force of the compression sping 26. The thread cutting lever roller 21B of the thread cutting lever 21 is disengaged from the thread cutting cam 25 fixed to the lower shaft 1.

As shown in FIGS. 1, 5, and 8, the thread cutting knife 14 is kept in a thread cutting inoperative position via the first turnable interlocking mechanism 44. That is, the thread cutting bell crank 22 and the thread cutting knife driving shaft 18 are rotated in the direction of the arrow as illustrated in FIG. 8 by the operation of the thread cutting return spring 24 which is held by the loop spreading plate driving link 23 while the thread cutting knife supporting member 6 incorporating the arm 6B as the driven body is rotated in the direction of the arrow as illustrated in FIG. 5 via the thread cutting operation arm 20 and the thread cutting operation link 16 as the driving body. The other end of the loop spreading plate driving arm 13 is restricted in its rotation by bringing into contact with the restriction ring 35 attached to the support shaft 36 projected from the bracket 30 whereby the thread cutting knife driving shaft 18 is restricted in its rotation. As a result, the thread cutting knife 14 integrated with the thread cutting knife supporting member 6 are held in an inoperative position free from the hook 3 and the throat plate T.

Figure 3:
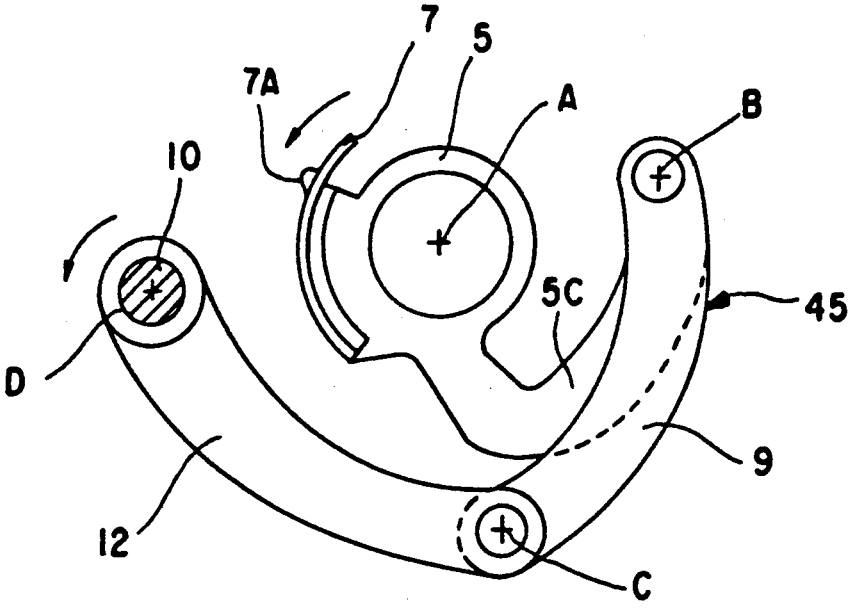
FIG. 3 illustrates a second turnable interlocking mechanism of FIG. 1 in a return state.

On the other hand, as shown in FIGS. 1, 3 and 8 the loop spreading plate 7 is held in an inoperative position via the second turnable interlocking mechanism 45. That is, the loop spreading plate fixing member 5 incorporating the arm 5C as the driven body is rotated in the direction of the arrow via the loop spreading plate driving arm 13, the loop spreading plate driving shaft 10, the loop spreading plate operation arm 12 and the loop spreading plate driving link 9 as the driving body. The other end 13B of the loop spreading plate driving arm 13 is restricted in its rotation by bringing into contact with the restriction ring 35 at the side of the bracket 30 whereby the loop spreading plate driving shaft 10 is restricted in its rotation. As a result, the loop spreading plate 7 integrated with the loop spreading plate fixing member 5 is rotated in the direction of the arrow and held in an operative position free from the hook 3 and the throat plate T.

The return bell crank 29 in the inoperative state is rotated in the clockwise direction from the state as shown in FIG. 13 by the operation of the return spring 32 and stopped at the position where the return bell crank 29 is brought into contact with the restriction pin 33 so that it is held disengaged from the return cam on the lower shaft 1.

After one piece of the cloth 41 is subjected to the stitching operation, the needle 29 is stopped to the lower stop position on the basis of the instruction from the control unit of the sewing machine and the pedal (not shown) is kicked so that the main shaft of the sewing machine is turned through half a rotation whereby the thread cutting driving unit 48 is actuated on the basis of the thread cutting signal when the needle 39 is moved to the upper stop position.

Figure 14:
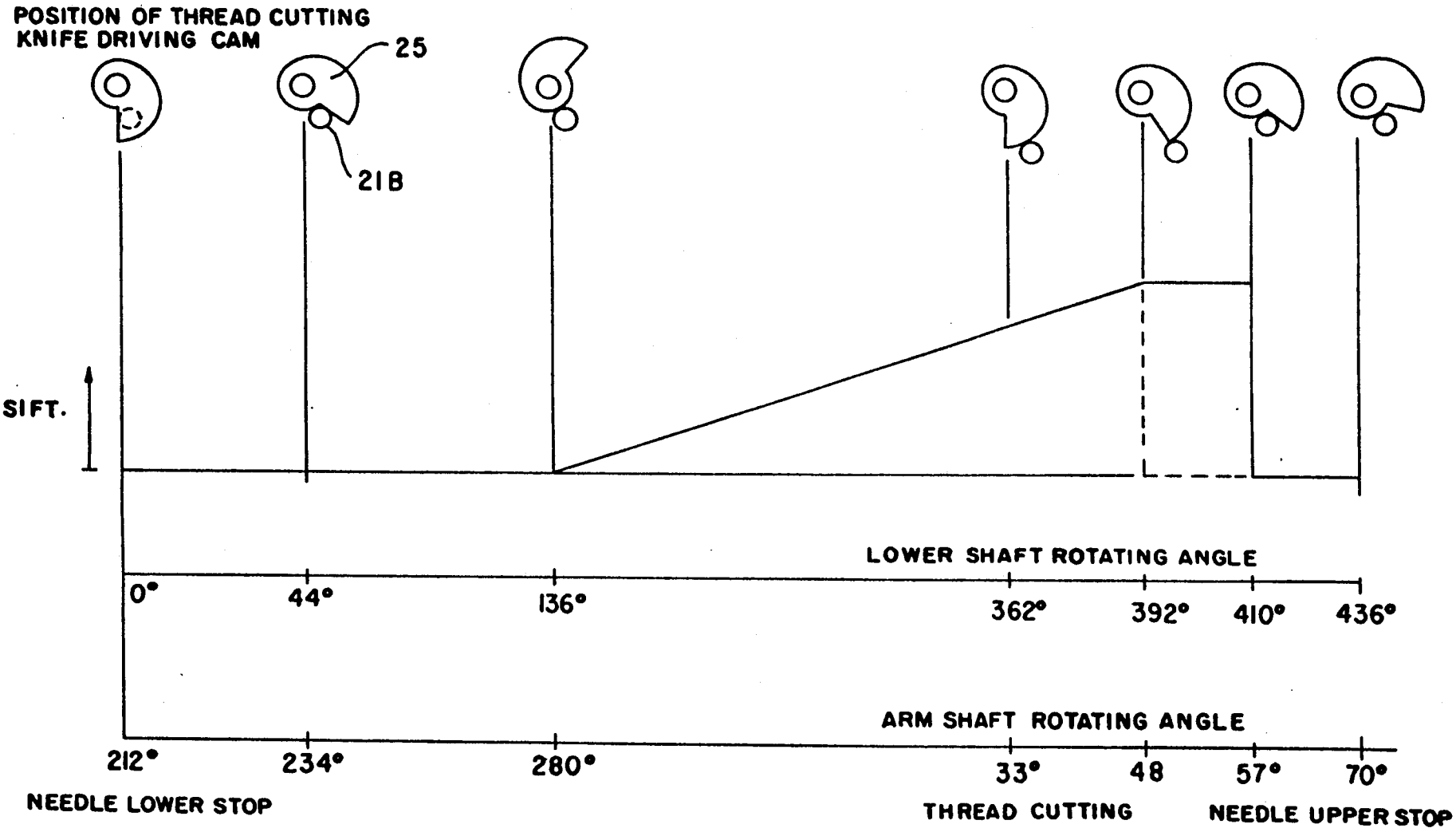
FIG. 14 is a view illustrating a relationship between the rotation of a thread cutting knife driving shaft and the angle of rotation of upper shaft and the lower shaft and the relationship between positions of the thread cutting cam and the angle of rotation of the upper shaft and the lower shaft.

The thread cutting operation will be described with reference to FIG. 14.

In the case the upper shaft is turned through 210 degrees, namely the turning angle of the upper shaft is 210 degrees when the needle is positioned on the lower stop position and the turning angle of the lower shaft 1 is 0 degrees, the solenoid 27 in FIG. 10 is actuated upon reception of the thread cutting signal issued from the control unit. The cylinder rod 27A is moved forward whereby the thread cutting lever 21 having the projection 21C capable of engaging in the ring groove 28A of the thread cutting operation ring 28 moves to the thread cutting bell crank 22 against the resilient force of the compression spring 26. At that time, the turning angle of the upper shaft as shown in FIG. 14 is between 212 degrees and 234 degrees where the turning angle of the lower shaft is between 0 degrees to 44 degrees in which the thread cutting lever roller 21B is brought into contact with the side surface of the largest diameter portion d of the thread cutting cam 25 for preventing the thread cutting lever roller 21B from being engaged with the cam surface of the thread cutting cam 25.

When the turning angle of the upper shaft reaches 280 degrees and the turning angle of the lower shaft is 136 degrees, the thread cutting lever roller 21B of the thread cutting lever 21 is engaged with the middle diameter portion b of the thread cutting cam 25 whereby the thread cutting lever 21 begins to rotate in the direction opposite to the direction of the arrow b with the rotation of the lower shaft 1 in the direction of the arrow a in FIG. 1. With the rotation of the thread cutting lever 21, the thread cutting bell crank 22 is rotated in the direction of the arrow as shown in FIG. 7 via the pin 22A engaged in the forked portion 21A of the thread cutting lever 21. At that time, the projection 21C integrated with the thread cutting lever 21 moves along the annular groove 28A of the thread cutting operation ring 28 fixed to the tip portion of the piston rod 27A.

With the rotation of the thread cutting bell crank 22, the thread cutting knife 14 mounted on the thread cutting knife supporting member 6 is rotated about the center A of the thread cutting knife supporting member 6, about the axial line of the lower shaft 1 via the first turnable interlocking mechanism 44, via the thread cutting knife driving shaft 18, the thread cutting knife operation arm 20 and the thread cutting knife operation link 16 whereby the thread cutting knife 14 enters the gap between the hook 3 and the throat plate T.

Figure 4:
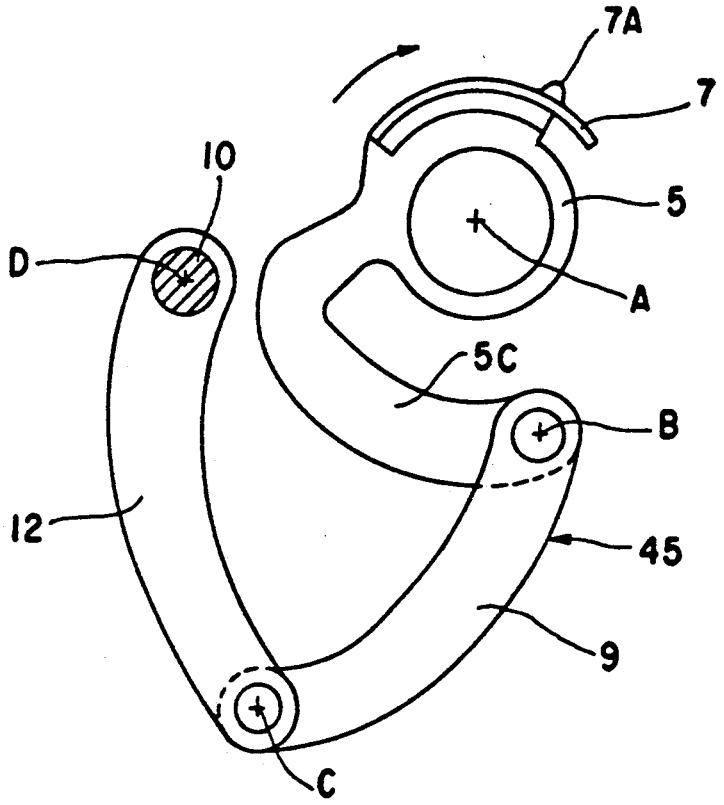
FIG. 4 illustrates a thread cutting operation state of the second turnable interlocking mechanism of FIG. 1.
Figure 11:
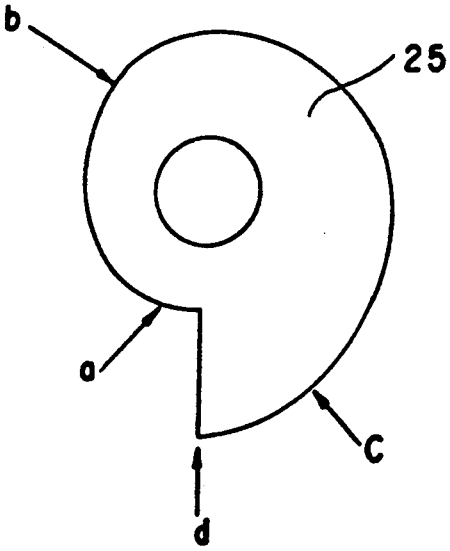
FIG. 11 is a view of a thread cutting cam of FIG. 1.
Figure 12:
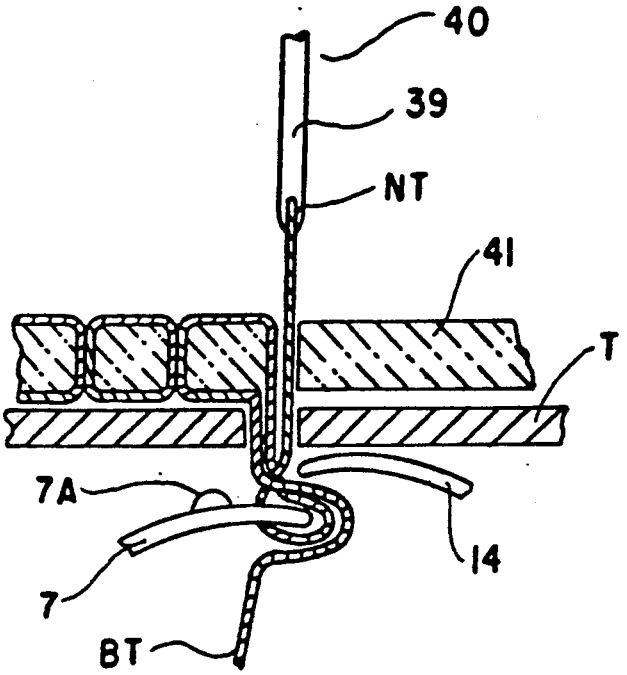
FIG. 12 is a view illustrating an operation of the thread cutting unit.

With the rotation of the thread cutting bell crank 22, since the loop spreading plate driving link 23 is lowered against the resilient force of the return spring 24 as shown in FIG. 1 and the loop spreading plate driving arm 13 is rotated together with the loop spreading plate driving shaft 10 in the direction opposite to the direction of the arrow c. The loop spreading plate 7 is rotated in the direction of the arrow via the second turnable interlocking mechanism 45 as shown in FIG. 4, via the loop spreading plate operation arm 12, the thread spreading plate driving link 9, and the thread spreading plate operating arm 12. The loop spreading plate 7 starts to cross the thread cutting knife 14 in the gap between the hook 3 and the throat plate T. At the time the turning angle of the upper shaft reaches 33 degrees, the thread lever roller 21B of the thread lever 21 begins to engage the large diameter portion c of the thread cutting cam 25 as shown in FIG. 11 whereby the upper thread NT and the bobbin thread BT drawn by the loop spreading plate 7 are cut off by the thread cutting knife 14 which is engaged with the projection 7A of the loop spreading plate 7 at the position just under the throat plate T.

With further rotation of the upper shaft to 48 degrees (where the turning angle of the lower shaft 1 392 degrees), the thread cutting cam 25 forces the thread cutting lever 21 to rotate until it reaches the largest diameter portion d. When the turning angle of the upper shaft exceeds 48 degrees the thread cutting lever roller 21B of the thread cutting lever 21 starts to engage sharply with the small diameter portion a of the thread cutting cam 25.

When the turning angle of the upper shaft reaches 57 degrees (where the turning angle of the lower shaft is 410 degrees), the return operation of the rotational motion transmission mechanism 43 is accelerated by the return cam 34 as shown in FIG. 13. That is, the largest diameter portion 34A of the thread cutting return cam 34 on the lower shaft 1 engages with the roller 29A of the thread cutting return crank 29. The pin 29B of the thread cutting return crank 29 pushes one end of the loop spreading plate driving arm 13 to cooperate with the thread cutting return spring 24. The thread cutting shaft 18 and the loop spreading plate driving shaft 10 safely rotate in the direction of the arrows b and a as shown in FIG. 1 which results in returning the thread cutting knife 14 and the loop spreading plate 7 to their original positions.

When the upper shaft turns up to 70 degrees, namely until the turning angle becomes 70 degrees (where the turning angle of the lower shaft is 436 degrees) and the needle 39 is positioned to the upper stop position, the signal issued from the control unit deactuate the solenoid 27. The cylinder rod 27A is entered and returned to the original inoperative position by the compression spring 26 whereby the thread cutting cam 25 is disengaged from the thread cutting lever roller 21B. As a result, the series of cutting operation is completed.

When the thread cutting lever 21 is disposed at the loop spreading plate driving shaft 10 and the rotational motion transmission unit 46 is disposed at the side of the loop spreading plate driving shaft 10, the rotational motion of the lower shaft 1 can be transmitted to the loop spreading plated driving shaft 10 by the rotational motion transmission unit 46. The rotational motion transmission mechanism 43 can be omitted if the rotational motion transmission unit 46 and the solenoid 27 are disposed at the side of the thread cutting knife driving shaft 18 and the loop spreading plate driving shaft 10 while the thread cutting cam 25 for operating each of the thread cutting lever roller 21B is disposed at the lower shaft 1, and a receiver for the compression spring 26 is made available, instead of the thread cutting bell crank 22, at the thread cutting knife driving shaft 18 and the loop spreading plate driving shaft 10.

A thread cutting unit in a sewing machine according to the present invention, the thread cutting knife and the loop spreading plate are respectively rotated by the four turnable interlocking mechanisms and are certainly engaged with each other in the slight gap between the throat plate and the hook thereby cutting off the stitched thread. As a result, it is possible to shorten precisely the thread end remaining on the sewn cloth.

In addition, inasmuch as the loop spreading plate fixing member and the thread cutting supporting member are respectively rotatably supported by the lower shaft while the thread cutting knife and the loop spreading plate are respectively rotated about the axial line of the lower shaft, it is possible to accommodate the thread cutting knife and the loop spreading plate in the periphery of the lower shaft whereby the thread cutting unit in the sewing machine can be easily incorporated in the sewing machine.

Moreover, inasmuch as the rotational motion between the loop spreading plate driving shaft and the thread cutting knife driving shaft is transmitted by the rotational motion transmission mechanism, either one of the loop spreading plate driving shaft and the thread cutting knife driving shaft may be rotatably driven by the lower shaft, whereby the structure of the thread cutting unit is simplified.

Inasmuch as the rotational motion of the lower shaft is transmitted to the thread cutting knife driving shaft or the loop spreading plate driving shaft, the rotational motion of the lower shaft can be transmitted to the thread cutting knife driving shaft or the loop spreading plate driving shaft with simple structure.

Although the invention has been described in its preferred form with a certain degree of particularity, it is to be understood that many variations and changes are possible in the invention without departing from the scope thereof.

What is claimed is:

1. A thread cutting unit in a sewing machine having a bed and comprising;

a lower shaft rotatably supported below the bed;

a needle movable vertically and held at a side of the bed;

a throat plate mounted on the bed;

a hook fixed to the lower shaft for cooperating with the needle, said needle extends beyond the throat plate at the time of stitching operation;

a thread cutting knife and a loop spreading plate respectively rotatably supported on the lower shaft and positioned adjacent to the hook, the thread cutting knife and the loop spreading plate crossing each other in the space between the hook and the throat plate for cutting a sewing thread after completion of a series of stitching operations; and a thread cutting driving unit for driving the thread cutting knife and the loop spreading plate;

wherein the thread cutting driving unit comprises:

a thread cutting knife driving shaft and a loop spreading plate driving shaft respectively rotatably supported below the bed of the sewing machine;

a rotational motion transmission device for respectively transmitting a rotational motion of the lower shaft to the thread cutting knife driving shaft and the loop spreading plate driving shaft;

a thread cutting supporting member having the thread cutting knife and rotatably supported below the bed;

a first turnable interlocking mechanism having interconnections at four different locations and having a driving body fixed to the thread cutting knife driving shaft and a driven body integrated with the thread cutting supporting member;

a loop spreading plate fixing member rotatably supported below the bed of the sewing machine and having a loop spreading plate; and a second turnable interlocking mechanism having interconnections at four different locations and having a driving body fixed to the loop spreading plate driving shaft and a driven body intergrated with the loop spreading plate fixing member.

2. A thread cutting unit as set forth in claim 1 wherein the loop spreading plate fixing member and the thread cutting knife supporting member are respectively rotatably supported on the lower shaft.

3. A thread cutting unit set forth in claim 2 further comprising a rotational motion transmission mechanism disposed between the thread cutting knife driving shaft and the loop spreading plate driving shaft.

4. A thread cutting unit as set forth in claim 3 wherein the rotational motion transmission device is provided with a thread cutting cam secured to the lower shaft.

* * * * *